US007123228B2

(12) United States Patent
Ozaki

(10) Patent No.: US 7,123,228 B2
(45) Date of Patent: Oct. 17, 2006

(54) LIQUID CRYSTAL DRIVE APPARATUS AND GRADATION DISPLAY METHOD

(75) Inventor: Yutaka Ozaki, 39-15, Sakuragaoka-machi, Tsuchiura-shi, Ibaraki 300-0832 (JP)

(73) Assignees: Hunet Display Technology Inc., Tokyo (JP); Yutaka Ozaki, Ibaraki (JP)

( * ) Notice: Subject to any disclaimer, the term of this patent is extended or adjusted under 35 U.S.C. 154(b) by 0 days.

(21) Appl. No.: 10/965,837

(22) Filed: Oct. 18, 2004

(65) Prior Publication Data

US 2005/0068280 A1 Mar. 31, 2005

Related U.S. Application Data

(63) Continuation of application No. 10/182,711, filed as application No. PCT/JP01/11247 on Dec. 21, 2001.

(30) Foreign Application Priority Data

Dec. 22, 2000 (JP) ..... 2000-391136
Jul. 18, 2001 (JP) ..... 2001-218440

(51) Int. Cl.
*G09G 3/36* (2006.01)

(52) U.S. Cl. ..... 345/89; 345/690

(58) Field of Classification Search ..... 345/87–104, 345/204–213, 690–693; *G09G 3/36*
See application file for complete search history.

(56) References Cited

U.S. PATENT DOCUMENTS 5,359,345 A 10/1994 Hunter
5,666,173 A 9/1997 Mase et al.
5,724,062 A 3/1998 Hunter
5,850,205 A 12/1998 Blouin
5,852,430 A * 12/1998 Endo ..... 345/101
6,069,676 A 5/2000 Yuyama
6,215,466 B1 * 4/2001 Yamazaki et al. ..... 345/89
6,239,781 B1 5/2001 Fujisawa
2002/0047824 A1 4/2002 Handschy

FOREIGN PATENT DOCUMENTS

| | | |
|---|---|---|
| CA | 2268357 | 10/1999 |
| JP | 63-231423 | 9/1988 |
| JP | 3-134624 | 6/1991 |
| JP | 3-134695 | 6/1991 |
| JP | 5-119733 | 5/1993 |
| JP | 6-265847 | 9/1994 |
| JP | 7-253765 | 10/1995 |
| JP | 8-054859 | 2/1996 |
| JP | 9-114421 | 5/1997 |
| JP | 9-292601 | 11/1997 |

(Continued)

OTHER PUBLICATIONS

English language Abstract of JP 11-296150.

(Continued)

*Primary Examiner*—Alexander Eisen
(74) *Attorney, Agent, or Firm*—Greenblum & Bernstein, P.L.C.

(57) ABSTRACT

A voltage with a predetermined pattern is applied to liquid crystals to drive the liquid crystals during a unit drive period of the liquid crystals and an application pattern according to the gradation data is set taking into account a value obtained by integrating the amount of transmitted light of liquid crystals at various points in time when each application pattern is applied to the liquid crystals. This allows a fine gradation display even if the liquid crystals are driven by only ON/OFF of a maximum rated voltage. As a result, it is possible to drive the liquid crystals at high speed and produce a multi-gradation display.

8 Claims, 14 Drawing Sheets

FOREIGN PATENT DOCUMENTS

| | | |
|---|---|---|
| JP | 10-49112 | 2/1998 |
| JP | 10-268849 | 10/1998 |
| JP | 11-38386 | 2/1999 |
| JP | 11-84341 | 3/1999 |
| JP | 11-296150 | 10/1999 |

OTHER PUBLICATIONS

English language Abstract of JP 8-54859.
English language Abstract of JP 3-134624.
English language Abstract of JP 5-119733.
English language Abstract of JP 10-49112.
English language Abstract of JP 63-231423.
English language Abstract of JP 11-84341.
Yamaguchi et al., "Fluorescent Liquid Crystal Color Display Using A Guest-Host UV Shutter And Phosphor Layers On The Inside Of The Cell," Japanese Journal of Applied Physics, Japan Society of Applied Physics, vol., 38, No. 6A/B, Part 2, pp. L652-L654 (Jun. 15, 1999), XP000902420.
English language Abstract of JP 9-292601.
English language Abstract of JP 7-253765.
English Language Abstract of JP 3-134695.

* cited by examiner

| GRADATION | ON – TIME |
|---|---|
| 0 | ○○ μs |
| 1 | ×× μs |
| 2 | △△ μs |
| ⋮ | ⋮ |

| GRADATION | ON PATTERN |
|---|---|
| 0 | #1 |
| 1 | #2 |
| 2 | #3 |
| ⋮ | ⋮ |

LIQUID CRYSTAL DRIVE APPARATUS AND GRADATION DISPLAY METHOD

This application is a continuation application of pending U.S. patent application Ser. No. 10/182,711 filed Aug. 8, 2002, the disclosure of which is expressly incorporated herein by reference in its entirety, which is a national stage application of PCT/JPO1/11247, filed on Dec. 21, 2001.

TECHNICAL FIELD

The present invention relates to a liquid crystal drive apparatus and gradation display method, and more particularly, to a liquid crystal drive apparatus and gradation display method according to a new gradation display system.

BACKGROUND ART

An active matrix type liquid crystal display apparatus producing a multi-gradation display is known in the prior art. This multi-gradation display is performed by selecting one reference voltage corresponding to the gradation display data from among as many reference voltages as display gradations using an analog switch and driving the liquid display apparatus at the selected reference voltage.

FIG. 1 is a block diagram showing a conventional liquid crystal drive apparatus for driving an active matrix type liquid crystal display apparatus. This liquid crystal drive apparatus is provided with first latch 1, second latch 2 and decoder 3 for every vertical pixel line of the liquid crystal display apparatus.

First latch 1 reads 3-bit gradation data D0 to D2 that specify 8 gradations for each vertical pixel line during one horizontal scanning period. That is, this gradation data D0 to D2 are latched by first latch 1 and held for only one horizontal scanning period.

Second latch 2 supplies gradation data D0 to D2 held in first latch 1 to decoder 3 in next one horizontal scanning period. Decoder 3 decodes gradation data D0 to D2 from second latch 2 and outputs decoded signals S0 to S7 to control terminals of analog switches A0 to A7 respectively.

These analog switches A0 to A7 selectively output reference voltages V0 to V7 supplied to the input terminal in association with decoded signals S0 to S7. That is, one of reference voltages V0 to V7 is selected by decoded signals S0 to S7 and output as a liquid crystal drive voltage.

Reference voltages V0 to V7 correspond to gradation levels as shown in FIG. 2. Therefore, a reference voltage is selected based on the gradation data, the reference voltage is output to the liquid crystal panel as a voltage to be applied, and in this way the amount of transmitted light corresponding to the applied voltage is obtained allowing a gradation display.

However, the conventional liquid crystal drive apparatus is not sufficient to drive liquid crystals at high speed. In line with widespread use of the Internet there is a growing demand for high-speed transmission of large-volume data such as images in recent years and multi-gradations are also required to be implemented. Displaying moving pictures in particular requires high-speed drive and a multi-gradation display of liquid crystals.

DISCLOSURE OF INVENTION

It is an object of the present invention to provide a new liquid crystal drive apparatus and gradation display method capable of driving liquid crystals at high speed and displaying multi-gradations as well.

This object is attained when a predetermined voltage is applied to liquid crystals by setting a time during which a voltage is applied to liquid crystals taking into account an area obtained by integrating an amount of transmitted light at various points in time of the liquid crystals over an LED light-emitting period.

BEST MODE FOR CARRYING OUT THE INVENTION

With reference now to the attached drawings, embodiments of the present invention will be explained in detail below.

(Embodiment 1)

Figure 1:
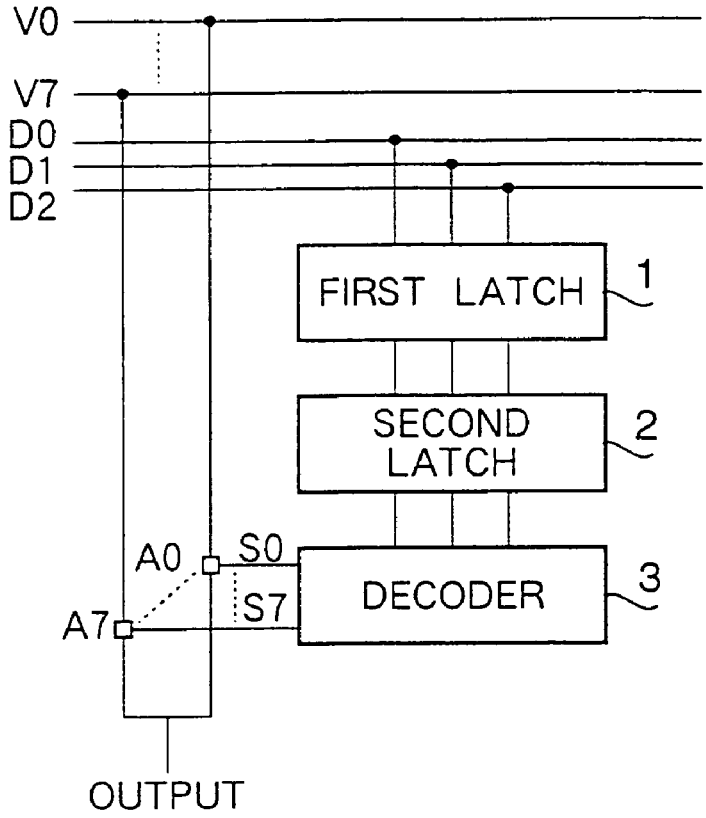
FIG. 1 is a block diagram showing an outlined configuration of a conventional liquid crystal drive apparatus.
Figure 2:
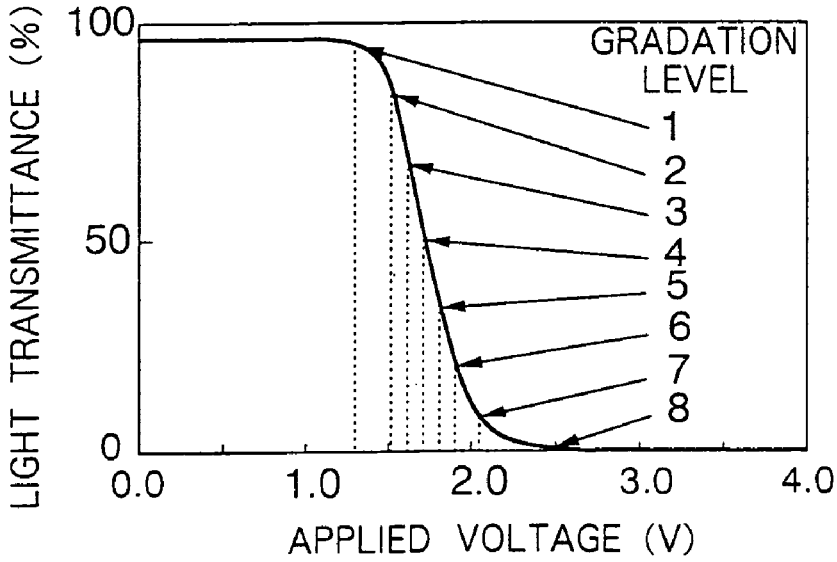
FIG. 2 illustrates a relationship between light transmittance and applied voltage.
Figures 3, 4:
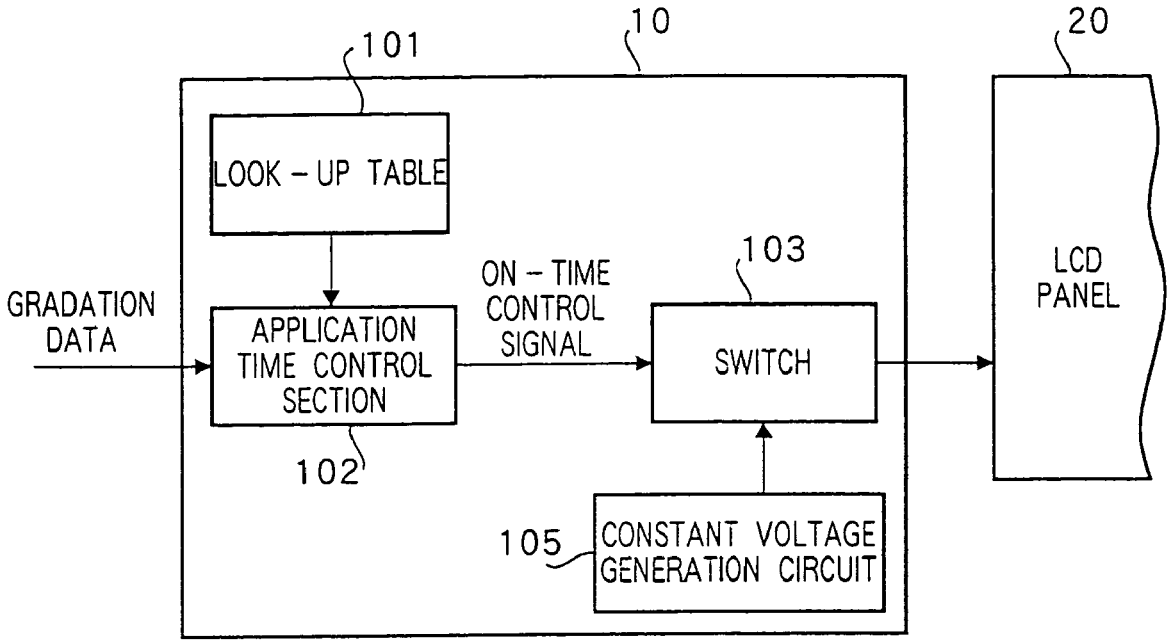
FIG. 3 is a block diagram showing an outlined configuration of a liquid crystal drive apparatus according to Embodiment 1 of the present invention.
FIG. 4 illustrates a look-up table at the liquid crystal drive apparatus shown in FIG. 3.

FIG. 3 is a block diagram showing an outlined configuration of a liquid crystal drive apparatus according to Embodiment 1 of the present invention. Liquid crystal drive apparatus 10 according to Embodiment 1 is provided with application time control section 102 that controls a voltage application time according to gradation data, look-up table 101 that associates gradation with application time (ON-time) and switch 103 that outputs a constant voltage generated by constant voltage generation circuit 105 to LCD panel 20 according to the ON-time control signal output from application time control section 102.

As shown in FIG. 4, look-up table 101 is a table that associates a gradation level with an application time during which the switch is ON. Here, a gradation display of the liquid crystal drive apparatus according to the present invention will be explained using FIG. 5 to FIG. 7.

Figure 5A:
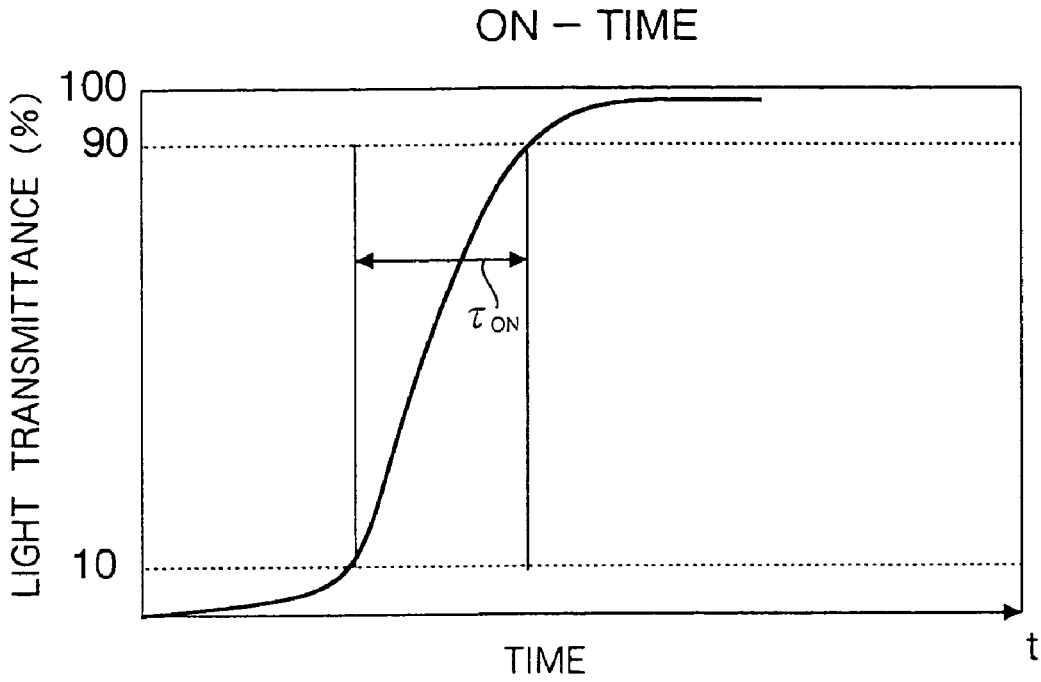
FIG. 5A illustrates a relationship between light transmittance and time when application of a voltage is started.
Figure 5B:
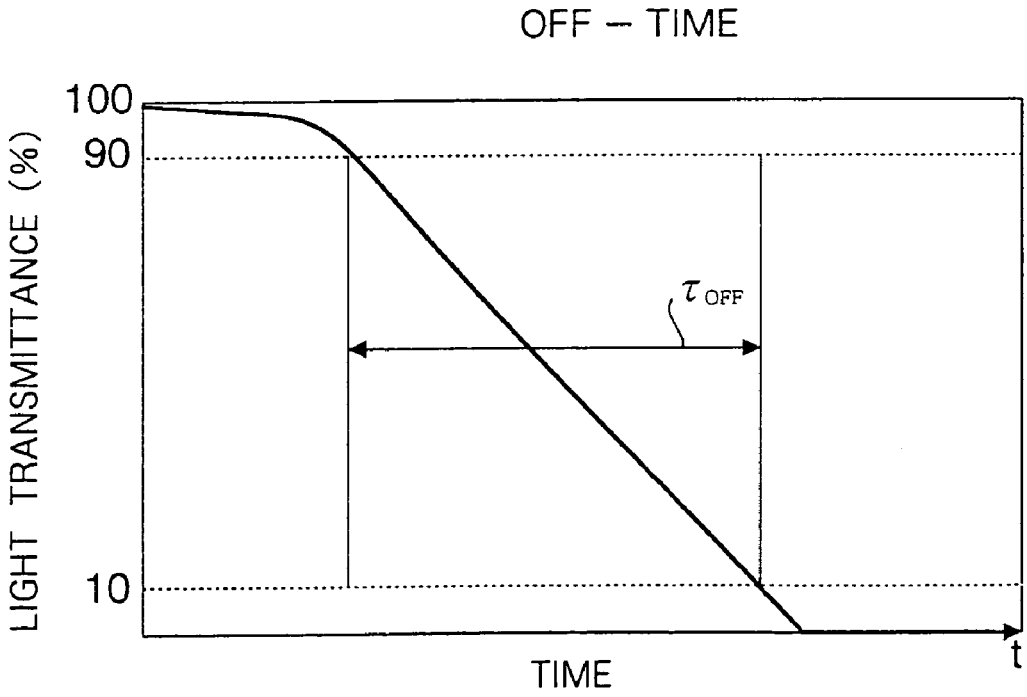
FIG. 5B illustrates a relationship between light transmittance and time when application of a voltage is stopped.
Figure 6:
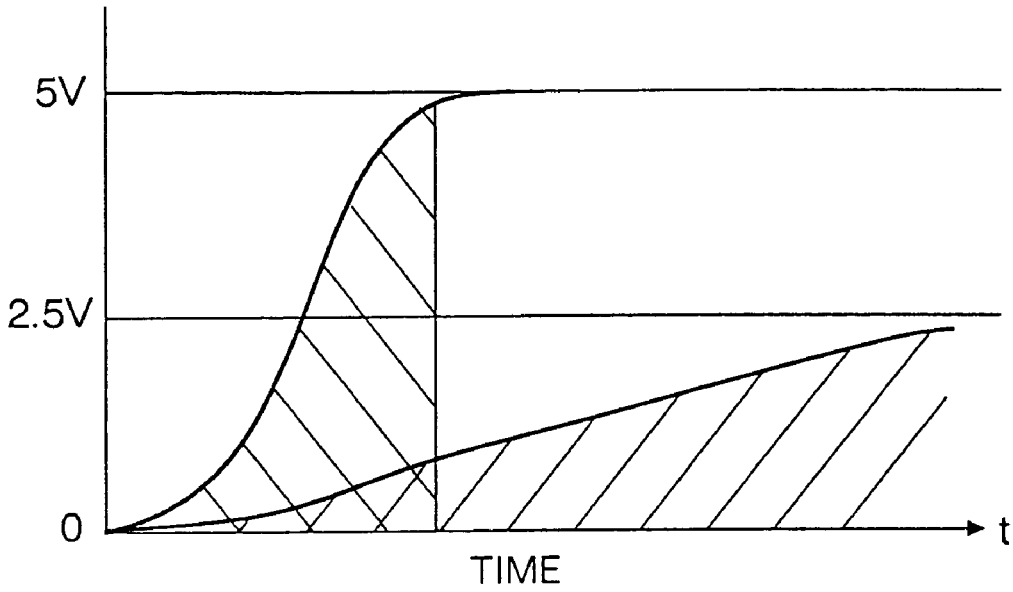
FIG. 6 illustrates a relationship between an applied voltage and time.
Figure 7:
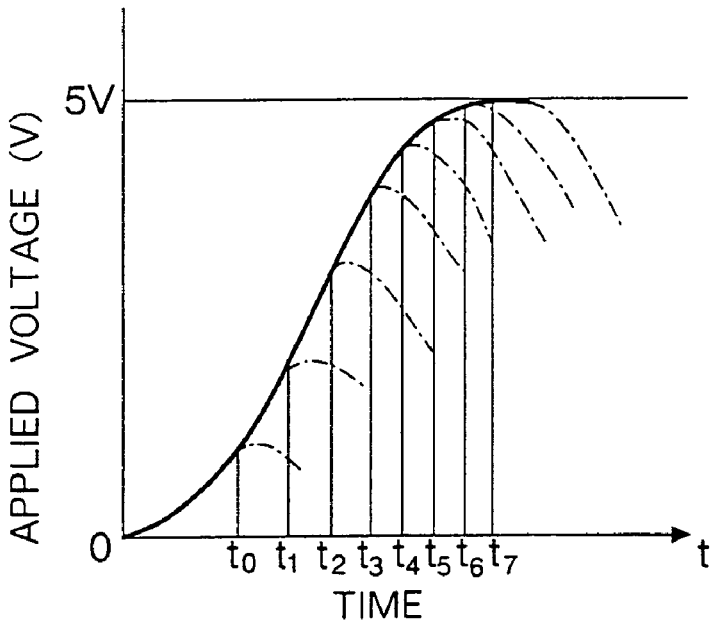
FIG. 7 illustrates a relationship between an applied voltage and time for each gradation.

FIG. 5 illustrates a relationship between light transmittance and time, FIG. 6 illustrates a relationship between an applied voltage and time and FIG. 7 illustrates a relationship between an applied voltage and time for each gradation.

When a voltage is applied to liquid crystals and the liquid crystals respond to this by allowing light to penetrate, the liquid crystals have light transmittance as shown in FIG. 5A. In FIG. 5A, suppose the time required for the light transmittance to change from 10% to 90% is τ ON.

On the other hand, when voltage application to the liquid crystals is stopped and light is shut off, the liquid crystals have light transmittance as shown in FIG. 5B. In FIG. 5B, suppose the time required for the light transmittance to change from 90% to 10% is τ OFF.

As is apparent from FIG. 5A and FIG. 5B, τ OFF is longer than τ ON. This means that there is a difference between the time after application of a voltage until liquid crystals respond to this allowing light to penetrate and the time after voltage application is stopped until light is shut off.

In this case, response speed τ ON of liquid crystals is expressed as $kG^2/(V^2-V_{th}^2)$, response speed τ OFF is expressed as $k'G^2$ (k, k': constants, V: applied voltage, $V_{th}$: threshold voltage, G: cell gap) As is seen from this expression, the response speed of liquid crystals differs between voltage application (τ ON) and stoppage of voltage application (τ OFF). Thus, the rate of voltage variation with time differs when a voltage is applied and when application of a voltage is stopped, that is, the rate of voltage variation with time is asymmetric.

As shown in FIG. 6, the (rise) time to reach an applied voltage value of liquid crystals differs when voltage 2.5 V is applied and when voltage 5 V is applied, and the time to reach the applied voltage value when voltage 5 V is applied is shorter.

As described above, when a voltage is applied to liquid crystals, the liquid crystals respond to this (opens up the aperture) allowing light to penetrate. When application of a voltage continues for a certain time, the liquid crystals continue to respond thereto and remain open continuously allowing light to penetrate. An amount of transmitted light for the duration of that time can be considered as a value obtained by integrating the applied voltage for the duration of that time. That is, the hatching area in FIG. 6 can be considered to indicate an amount of transmitted light. To be specific, the amount of transmitted light in the case of the applied voltage of 5 V is the area expressed by leftward ascending lines in FIG. 6, while the amount of transmitted light in the case of the applied voltage of 2.5 V is the area expressed by rightward ascending lines in FIG. 6.

In gradation displays by a conventional liquid crystal drive, reference voltages such as 2.5 V and 5 V as shown in FIG. 6 are preset and the reference voltages are applied to the liquid crystals. As described above, when the amount of transmitted light is considered as a total amount of opening time, that is, applied voltage×time (area expressed with hatching in FIG. 6), it is possible to control the application duration (t0 to t7) with the applied voltage kept constant as shown in FIG. 7. In other words, in FIG. 7, when the application time is changed, the waveform changes from a rise to fall and the area in the waveform (applied voltage× time) changes accordingly. As a result, the amount of transmitted light varies, which allows a gradation display to be implemented.

Since such a gradation display can keep the applied voltage constant, it is possible to perform timing control the application condition or non-application condition, that is, digital control. Digital control facilitates control. Furthermore, control is performed at all gradation levels with a relatively high applied voltage which results in quicker response of liquid crystals, which makes it possible to shorten the liquid crystal drive time as a whole.

Next, an operation of the liquid crystal drive apparatus in the above-described configuration will be explained.

Gradation data indicating gradation levels in a gradation display is input to application time control section 102 of liquid crystal drive apparatus 10. The gradation data is expressed with, for example, 3 bits in the case of 8 gradations and set as gradation levels 0 to 7.

Figure 8:
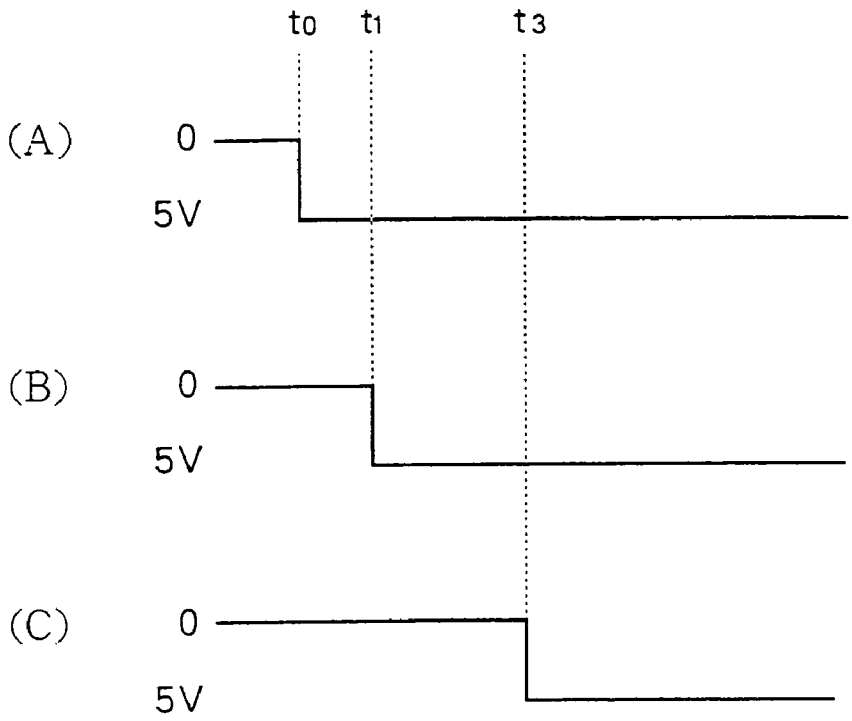
FIG. 8A illustrates voltage application timing.
FIG. 8B illustrates voltage application timing.
FIG. 8C illustrates voltage application timing.

Upon receipt of the gradation data, application time control section 102 references look-up table 101 shown in FIG. 4 and sets an application time (ON-time) corresponding to the gradation data. Then, application time control section 102 outputs an ON-time control signal to switch 103 for the decided ON-time. In this way, a gradation display is carried out by digital-controlling the application time corresponding to a predetermined applied voltage as shown in FIG. 8A to 8C.

Switch 103 turns ON the switch according to the ON-time control signal from application time control section 102 to apply a voltage to pixels of LCD panel 20. That is, switch 103 supplies a signal voltage to the source electrode line according to the ON-time control signal to drive liquid crystals.

In this way, the liquid crystal drive apparatus according to this embodiment allows a multi-gradation display through digital control. This facilitates control in a multi-gradation display. Furthermore, time control is performed at all gradation displays with a relatively high applied voltage which results in quicker response of liquid crystals, which makes it possible to shorten the liquid crystal drive time as a whole. Furthermore, as a voltage is applied in a digitized manner through time control with the liquid crystal drive voltage kept constant, which eliminates the need for a D/A (digital/analog) converter which is normally required for a liquid crystal drive apparatus.

(Embodiment 2)

Figure 9:
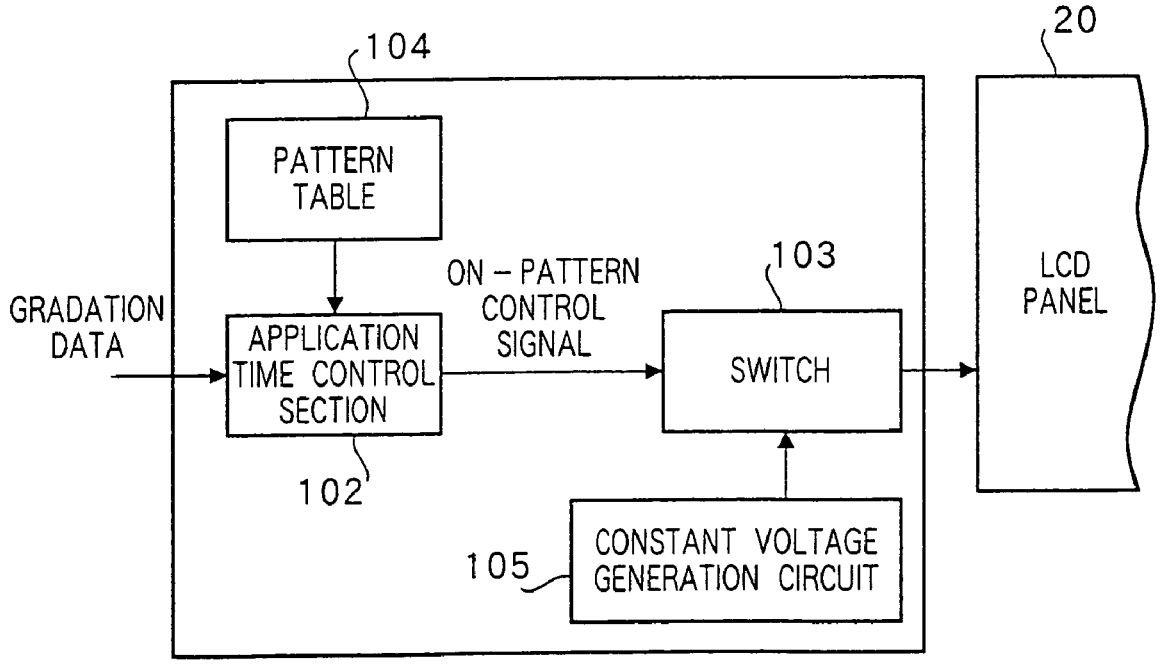
FIG. 9 is a block diagram showing an outlined configuration of a liquid crystal drive apparatus according to Embodiment 2 of the present invention.

FIG. 9 is a block diagram showing an outlined configuration of a liquid crystal drive apparatus according to Embodiment 2 of the present invention. The liquid crystal drive apparatus according to Embodiment 2 is provided with application time control section 102 that controls a voltage application time according to gradation data, pattern table 104 that associates a gradation with an application time (ON-pattern) and switch 103 that outputs a constant voltage generated by constant voltage generation circuit 105 to LCD panel 20 according to an ON pattern control signal output from application time control section 102.

Figures 10, 11:
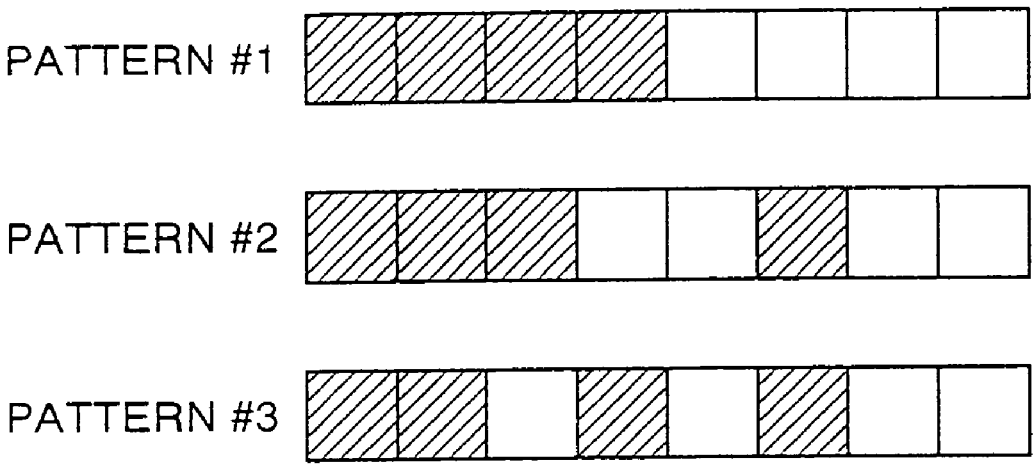
FIG. 10 illustrates a pattern table at the liquid crystal drive apparatus shown in FIG. 9.
FIG. 11 illustrates voltage application patterns.

As shown in FIG. 10, pattern table 104 is a table that associates a gradation level with an application pattern for turning ON the switch. As applied patterns, there can be, for example, patterns whereby a predetermined liquid crystal drive time as shown in FIG. 11 is divided into a plurality of blocks at which application or non-application of a voltage is selected.

When a voltage is applied to liquid crystals, a rise and fall are asymmetric as shown in FIG. 5A and FIG. 5B. Therefore, taking advantage of this asymmetry, even if a voltage application time is the same, when different patterns are used as shown in FIG. 11, the area of applied voltage×time varies depending on a combination of voltage application units (one block in the patterns in FIG. 11). As a result, it is possible to perform a finer gradation display than Embodiment 1.

For example, instead of changing a voltage application time between LED unit light emission periods as in the case of conventional PWM control, this embodiment changes a voltage application pattern within a unit light emission period. The "LED unit light emission period" here refers to a period after LEDs (light-emitting diodes) provided for respective liquid crystals start to emit light until the LEDs stop light emission.

By the way, this embodiment is supposed to perform a display using a field sequential method, use an LED array as backlight and flash this LED array at high speed. That is, the above-described unit light emission period corresponds to one LED array lighting-up period.

Thus, by changing the voltage application pattern within the LED unit light emission period, it is possible to perform a much finer gradation display compared to conventional PWM control, for example.

Then, an operation of the liquid crystal drive apparatus in the above-described configuration will be explained.

Gradation data indicating gradation levels in a gradation display is input to application time control section 102 of liquid crystal drive apparatus 10. The gradation data is expressed with, for example, 4 bits in the case of 16 gradations and set as gradation levels 0 to 15.

Upon receipt of the gradation data, application time control section 102 references pattern table 104 shown in FIG. 10 and decides an application pattern (ON pattern) corresponding to the gradation data. Then, application time control section 102 outputs an ON pattern control signal to switch 103 for the decided ON pattern.

Switch 103 turns ON the switch according to the ON pattern control signal from application time control section 102 to apply a voltage to pixels of LCD panel 20. That is, switch 103 supplies a signal voltage to the source electrode line according to the ON pattern control signal to drive liquid crystals.

In this way, the liquid crystal drive apparatus according to this embodiment allows a multi-gradation display through digital control. This facilitates control in a multi-gradation display. Furthermore, time control is performed at all gradation levels with a relatively high applied voltage which results in quicker response of liquid crystals, and therefore it is possible to shorten the liquid crystal drive time as a whole. Furthermore, as a constant liquid crystal drive voltage is applied in a digitized manner through time control, there is no need for a D/A (digital/analog) converter, which is normally required for a liquid crystal drive apparatus.

Furthermore, the liquid crystal drive apparatus according to this embodiment expresses gradations by combining voltage application units using a symmetry between rise and fall of voltage application, and therefore it is possible to display more gradations.

Furthermore, by changing voltage application patterns within an LED unit light emission period allows a finer gradation display.

(Embodiment 3)

This embodiment sets a voltage application time (or voltage application pattern) corresponding to a gradation considering the area obtained by integrating the amount of transmitted light of liquid crystals at various points in time over an LED light emission period when a maximum rated voltage of the liquid crystals is applied. More specifically, as shown in FIG. 12, the area (area indicated by hatching of the drawing) obtained by integrating the waveform amount of transmitted light that penetrates the liquid crystals when a drive voltage is applied over the LED light emission period is associated with each gradation.

Figure 12A:
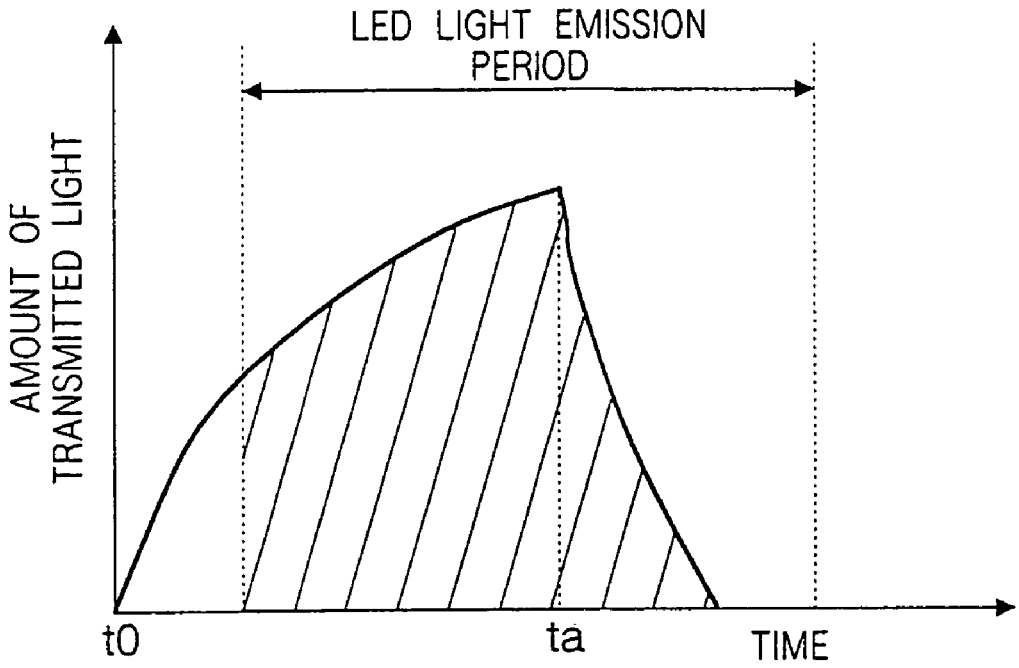
FIG. 12A illustrates a relationship between an amount of transmitted light and time when a certain voltage is applied.
Figure 12B:
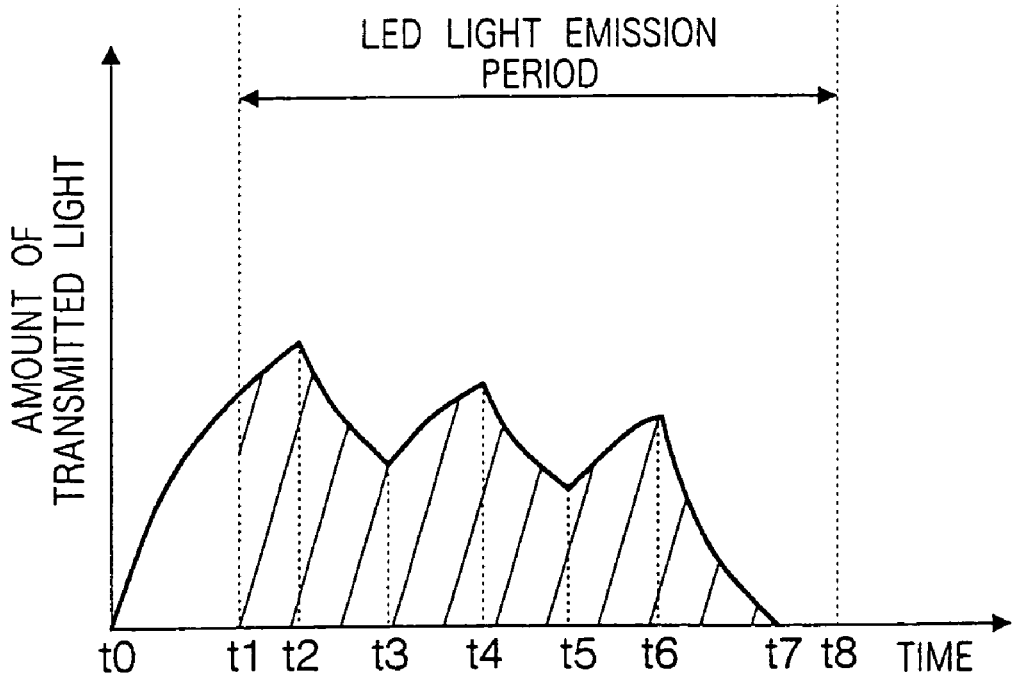
FIG. 12B illustrates a relationship between an amount of transmitted light and time when a pattern voltage of pattern #3 in FIG. 11 is applied.

That is, the liquid crystals are driven in such a way that the area of the hatching area in FIG. 12 increases as the input gradation data shows higher gradations. Since the applied voltage is actually set to be constant at a maximum rated voltage of the liquid crystals, the area of the hatching is changed according to the gradation by changing the voltage application time (or voltage application pattern). By the way, FIG. 12A illustrates a variation in an amount of transmitted light of liquid crystals with time when an applied voltage is set to ON during a period from time t0 to ta, and FIG. 12B illustrates a variation in an amount of transmitted light of liquid crystals with time when a voltage of a predetermined pattern is applied to liquid crystals. More specifically, FIG. 12B shows a case where the voltage of applied pattern #3 in FIG. 11 is applied and shows a case where an ON voltage is applied during a period from time t0 to t2, a period from time t3 to t4 and a period from time t5 to t6.

Thus, the liquid crystal drive apparatus of this embodiment sets a voltage application time for liquid crystals by associating the area obtained by integrating the amount of transmitted light over the LED light emission period with each gradation, and in this way even if liquid crystals are driven by a constant applied voltage, it is possible to perform a fine gradation display as if liquid crystals were driven by an analog voltage.

Furthermore, by applying an ON/OFF pattern voltage to liquid crystals taking into account the area of the amount of transmitted light during the LED light emission period, it is possible to perform a much finer gradation display according to gradation data. That is, as is apparent from a comparison between FIG. 12A and FIG. 12B, applying an ON/OFF pattern voltage (FIG. 12B) makes it possible to select the area of the amount of transmitted light during the LED light emission period in a finer way, and therefore finer gradation expression is possible. For example, when a 10-bit ON/OFF pattern is set, 1024 ways of gradation expression is possible for each of R, G and B.

Furthermore, this embodiment is intended to apply an ON/OFF pattern voltage to liquid crystals at a predetermined time before the time at which the LED actually emits light. As a result, desired transmittance can be obtained from the time at which the LED starts to emit light, and therefore it is possible to increase brightness of the display screen without the need to increase the LED output.

Figure 13:
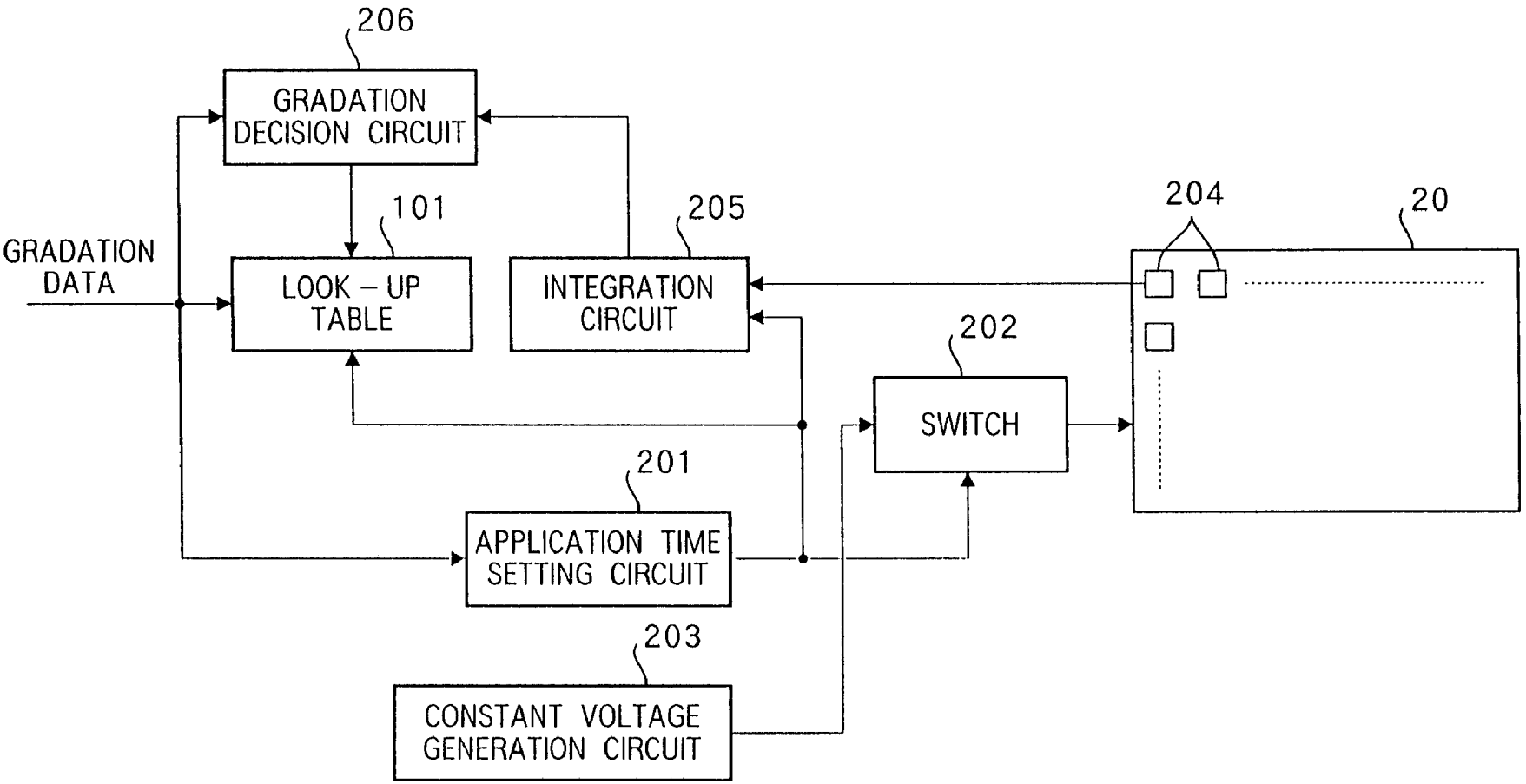
FIG. 13 is a block diagram to illustrate the creation of a look-up table used for a liquid crystal drive apparatus according to Embodiment 3 of the present invention.

Such a liquid crystal drive apparatus can be implemented by creating look-up table 101 of above-described liquid crystal drive apparatus 10 in Embodiment 1 as shown below. FIG. 13 shows an apparatus to create look-up table 101 and reference table 101 stores a voltage application time (or voltage application pattern) associated with the gradation data.

The look-up table creation apparatus allows gradation data to be input to application time setting circuit 201. Application time setting circuit 201 sets a plurality of application times (or a plurality of application patterns) for every gradation specified by gradation data. That is, application time setting circuit 201 sets a plurality of application times for one piece of gradation data from short to long application times one by one. The application time (or application pattern) set in this way is used as an ON/OFF control signal of switch 202.

When a constant voltage (maximum rated voltage 5 [v] in the case of this embodiment) is always input from constant voltage generation circuit 203 to switch 202 and this voltage is applied to liquid crystals of LCD panel 20 as a drive voltage for the time set by application time setting circuit 201.

LCD panel 20 is provided with brightness sensors 204 and an amount of transmitted light obtained from brightness sensors 204 is sent to integration circuit 205. Integration circuit 205 calculates the area indicated by hatching of FIG. 12 by integrating the amount of transmitted light over the LED light emission period and sends this area to gradation decision circuit 206. Gradation decision circuit 206 is also fed gradation data. Gradation decision circuit 206 compares each gradation with the integrated area and sends a write control signal to allow the data to be written in look-up table 101 when the area corresponding to the gradation is input.

Look-up table 101 is given gradation data and application time information (or application pattern information) as write information and the gradation data is associated with the application time (or application pattern) and written when gradation decision circuit 206 enables a write. Thus, look-up table 101 stores the voltage application time (or voltage application pattern) corresponding to each gradation taking into account the area of the hatching in FIG. 12.

Figure 14:
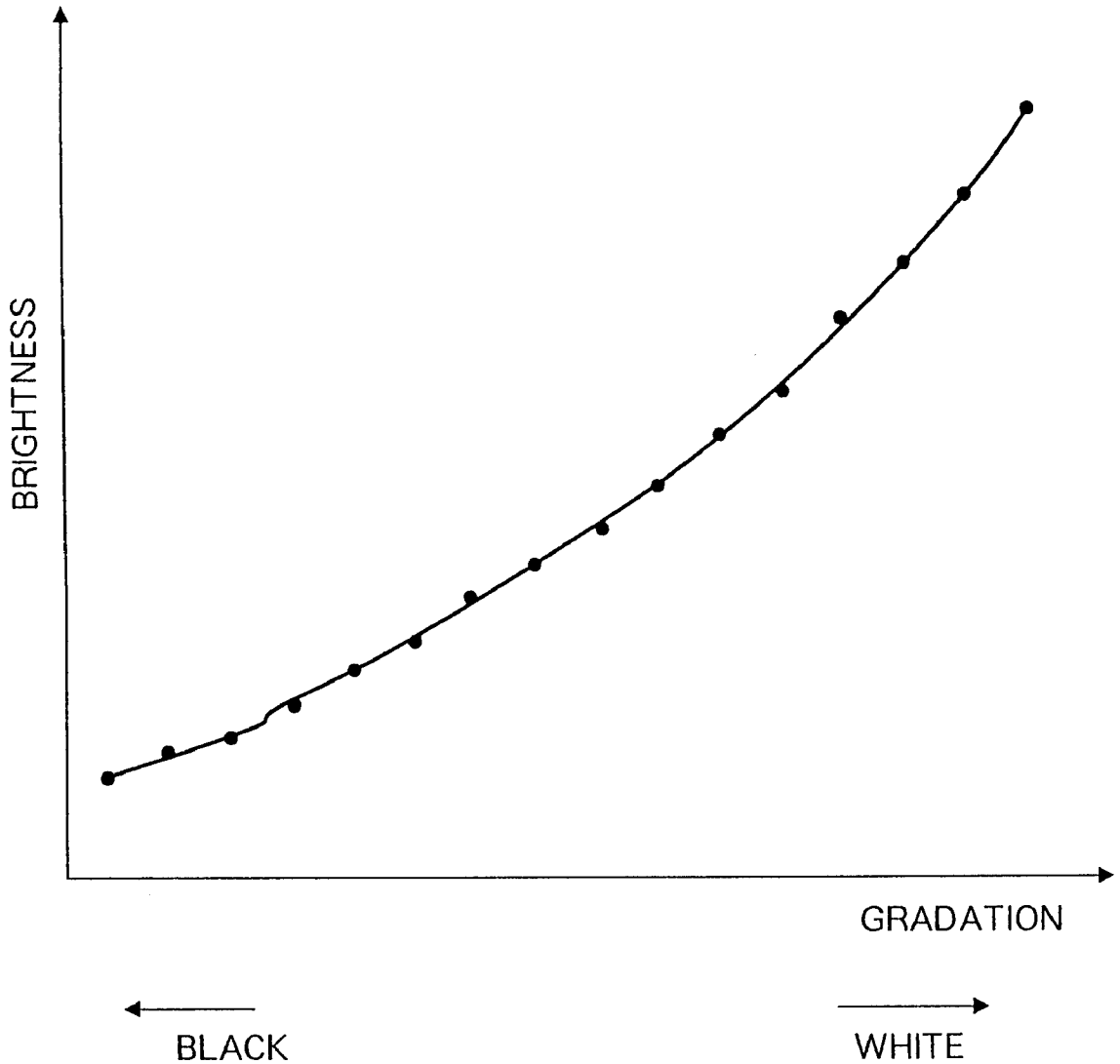
FIG. 14 is a characteristic curve to illustrate gamma correction.

By the way, when an actual image is displayed, it is ideal to select points in such a way that the relationship between gradation and brightness is plotted on a gamma curve as shown in FIG. 14. At this time, when a voltage with a different application pattern is applied to the liquid crystals within the light emission period of each LED as shown in this embodiment, it is possible to create very many gradations depending on the application patterns, which makes it easier to select points on the gamma curve and allows high precision gamma correction.

Figure 15A:
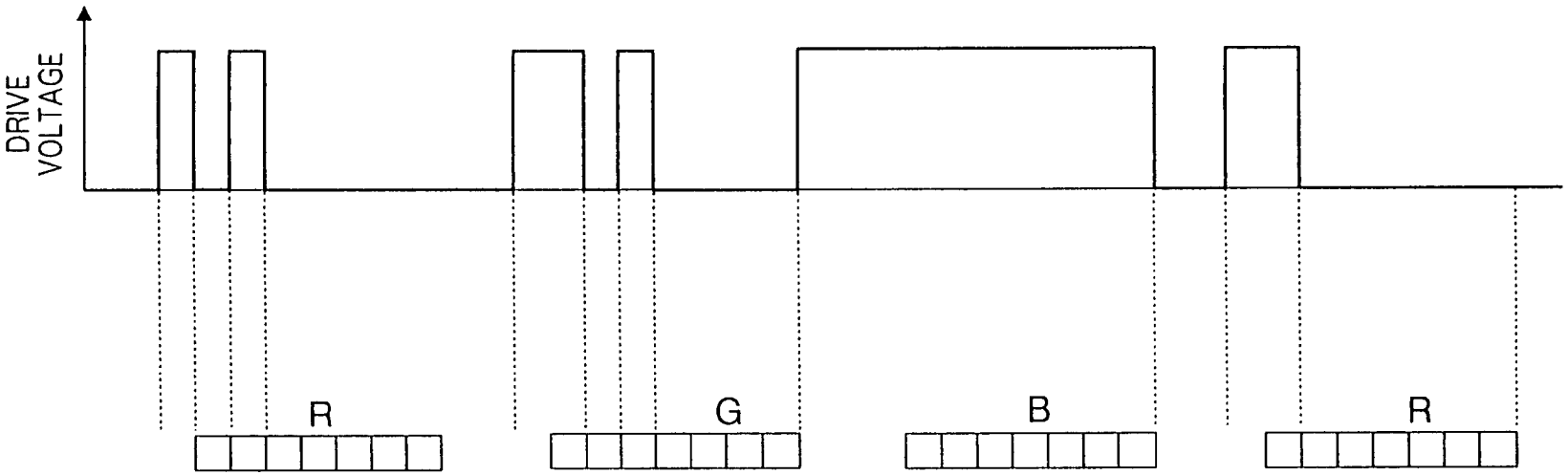
FIG. 15A is a drive voltage waveform chart showing an example of a pattern voltage applied to liquid crystals.
Figure 15B:
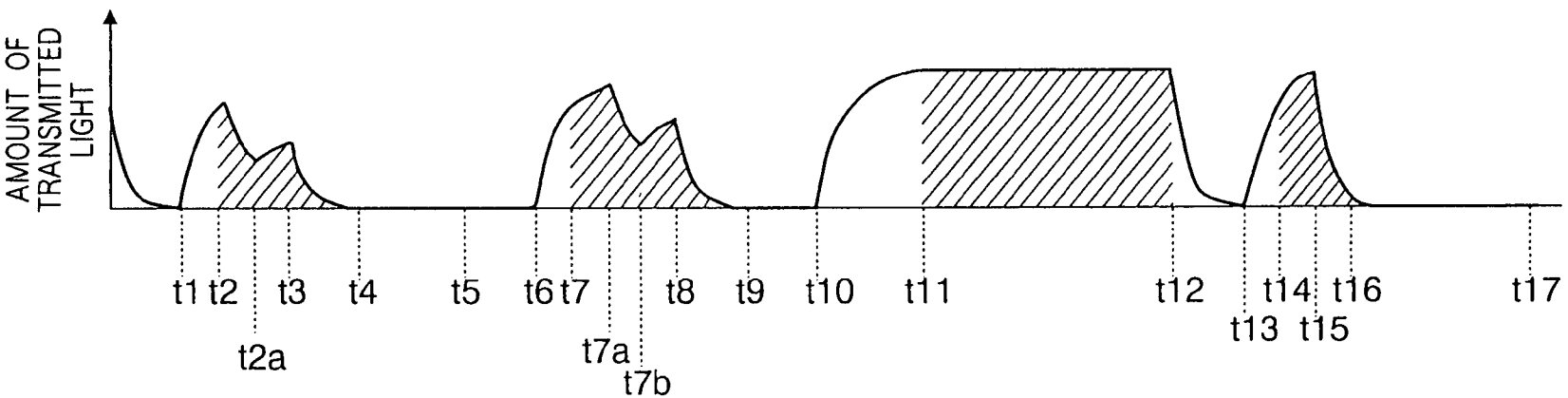
FIG. 15B illustrates an area of an amount of transmitted light when the pattern voltage in FIG. 15A is applied.

Then, an operation of the liquid crystal drive apparatus of this embodiment will be explained using FIG. 15. FIG. 15A shows a drive voltage waveform applied to the liquid crystals. FIG. 15B is a waveform chart showing an amount of transmitted light of the liquid crystals when the pattern voltage in FIG. 15A is applied. Furthermore, parts marked R, G and B in the figure indicate the LED light emission periods of respective colors.

That is, when a drive voltage is applied at time t1, the amount of transmitted light starts to rise from this time t1. When time t2 is reached, an R (red) LED emits light. Then, when the application of the drive voltage ends at time t2, the amount of transmitted light starts to fall from this time t2. Then, when an ON voltage is applied from time t2*a* to time t3, the amount of transmitted light rises during this period. Then, when the application of the drive voltage ends at time t3, the amount of transmitted light starts to fall from this time t3 and the amount of light is reduced to 0 at time t4. By the way, the amount of transmitted light continues to rise for a period from time t1 to time t2, but since no LED emits light, no LCD display is produced.

Likewise, when a drive voltage is applied at time t6, the amount of transmitted light starts to rise from this time t6. When a G (green) LED starts to emit light at time t7, an LCD display starts from this time t7. Then, the application of the drive voltage ends at time t7*a*, the amount of transmitted light starts to fall from this time t7*a*. Then, an ON voltage is applied for a period from time t7*b* to time t8, the amount of transmitted light rises. Then, the application of the drive voltage ends at time t8, the amount of transmitted light starts to fall from this time t8, the amount of transmitted light is reduced to 0 at time t9 and the display ends.

Likewise, when a drive voltage is applied at time t10, the amount of transmitted light starts to rise from this time t10 and when a B (blue) LED starts to emit light at time t11, an LCD display starts from this time t11. Then, when the application of the drive voltage ends at time t12, light emission of LED also stops and the display ends. By the way, the area enclosed by the amount of transmitted light and light emission period reaches a maximum with this B (blue) display, which means that this liquid crystal displays a maximum gradation.

Likewise, when a drive voltage is applied at time t13, the amount of transmitted light starts to rise from this time t13, and when an R (red) LED starts to emit light at time t14, an LCD display starts from this time t14. Then, when the application of the drive voltage ends at time t15, the amount of transmitted light starts to fall from this time t15, the amount of transmitted light is reduced to 0 at time t16 and the display ends.

As shown above, the liquid crystal drive apparatus of this embodiment is designed to drive liquid crystals by a maximum rated voltage, and therefore the waveform of the amount of transmitted light rises and falls abruptly as shown in FIG. 15B, making it possible to increase the response speed of liquid crystals. This also allows, for example, the frame frequency to be increased.

Moreover, since a voltage application time is set taking into account the area obtained by integrating the amount of transmitted light over an LED light emission period, it is possible to produce a fine gradation display suited to gradations.

In addition, applying an ON/OFF pattern voltage taking into consideration the area obtained by integrating the amount of transmitted light over an LED light emission period allows a much finer gradation display according to gradation data.

Figure 16A:
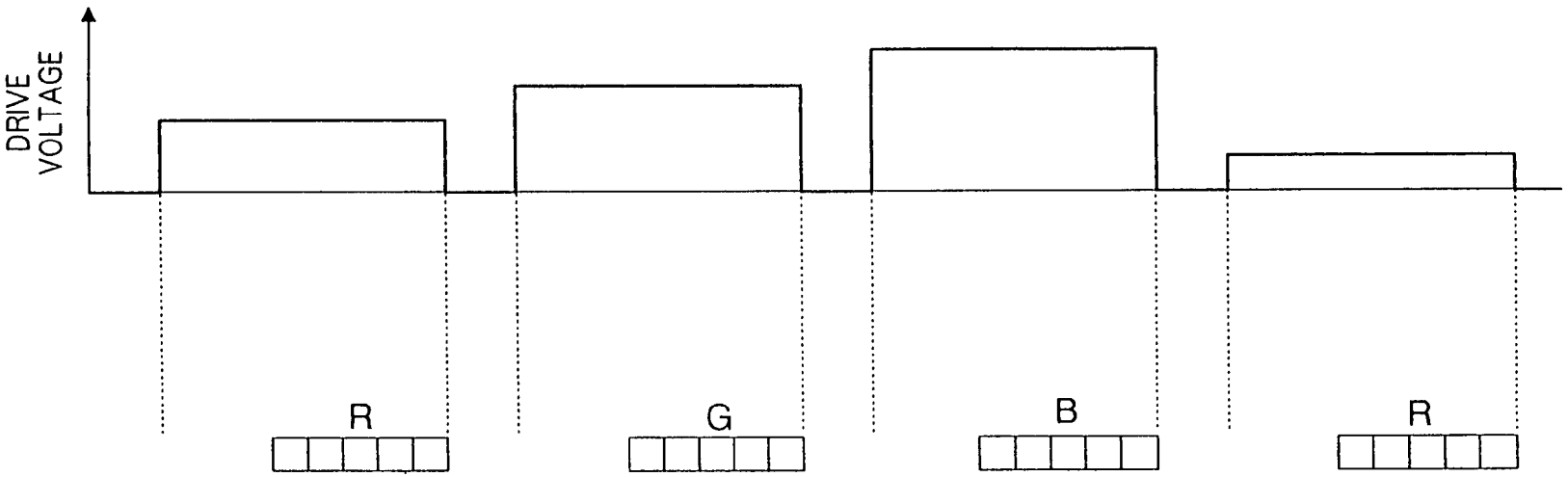
FIG. 16A is a drive voltage waveform chart according to a conventional variable application voltage system.
Figure 16B:
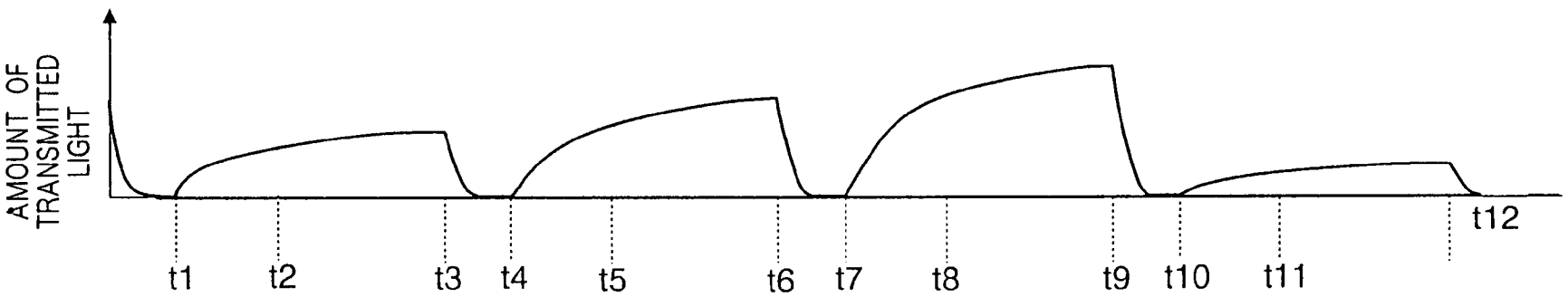
FIG. 16B illustrates an amount of transmitted light when the voltage in FIG. 16A is applied.

Here, FIG. 16 shows a waveform obtained by driving liquid crystals according to a conventional variable application voltage system as an example of a comparison with the liquid crystal drive apparatus of this embodiment. According to this liquid crystal drive system, the applied voltage value is increased as the specified gradation increases.

That is, when a medium drive voltage is applied over a period from time t1 to time t3, an amount of transmitted light according to this voltage value is obtained from liquid crystals. Likewise, when a relatively large drive voltage is applied over a period from time t4 to time t6, a relatively large amount of transmitted light according to this voltage value is obtained from liquid crystals.

When a maximum drive voltage is applied over a period from time t7 to time t9, a maximum amount of transmitted light according to this voltage value is obtained from liquid crystals. Furthermore, when a small drive voltage is applied over a period from time t10 to time t12, a small amount of transmitted light according to this voltage value is obtained from liquid crystals. By the way, an LCD display is actually produced over a period from time t2 to t3, a period from time t5 to t6, a period from time t8 to t9 and a period from time t11 to t12, during which the respective RGB LEDs emit light.

During liquid crystal driving according to this variable application voltage system, a drive voltage value is set by focusing attention on an average height of the waveform of the amount of transmitted light during each display period. For example, a drive voltage is set in such a way that an average height of the amount of transmitted light over the period from time t2 to time t3 satisfies the specified gradation.

In contrast, during liquid crystal driving according to the amount of transmitted light integration system of this embodiment, liquid crystals are driven taking into account the integrated area of the amount of transmitted light, and therefore it is possible to express more visually appealing fine gradations than the conventional liquid crystal drive system.

Thus, the liquid crystal drive apparatus of this embodiment controls a drive voltage based on a value obtained by integrating the amount of transmitted light from liquid crystals, which results in a quicker change of a drive voltage applied to liquid crystals than the response time (ON/OFF) of the liquid crystals. This makes it possible to control the level of aperture of each liquid crystal at optimal timing and obtain desired brightness.

(Embodiment 4)

Figure 17:
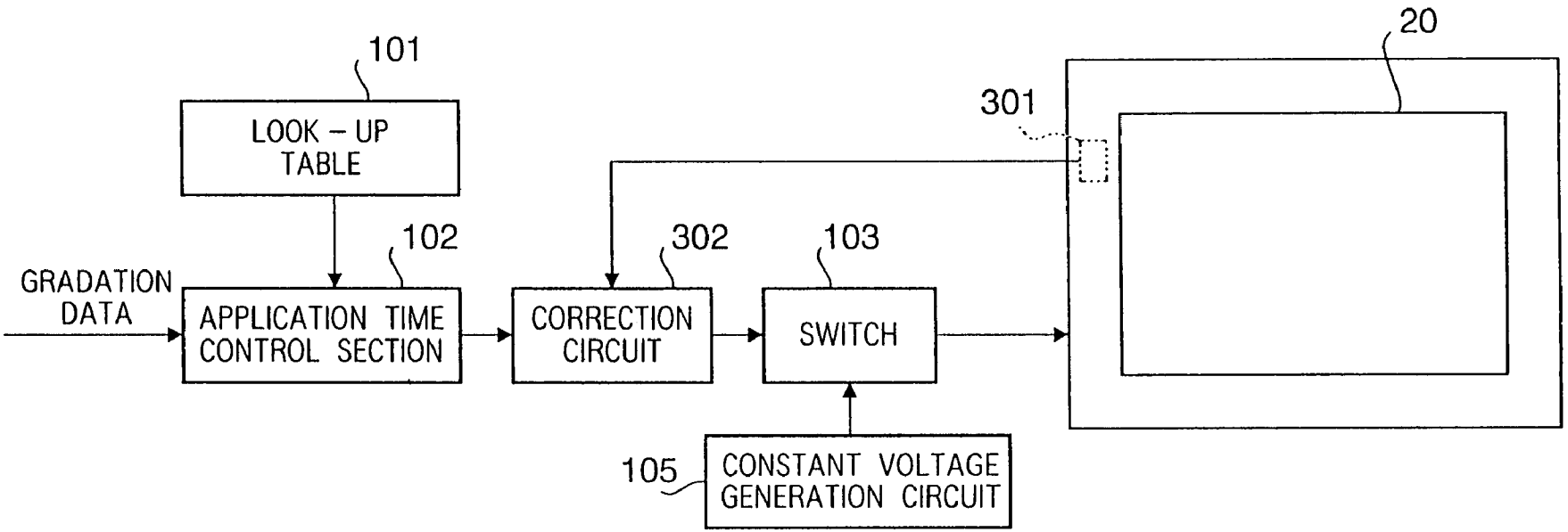
FIG. 17 is a block diagram showing an outlined configuration of a liquid crystal drive apparatus according to Embodiment 4 of the present invention.

FIG. 17 shows a configuration of a liquid crystal drive apparatus according to Embodiment 4 of the present invention, wherein the components corresponding to those in FIG. 3 are assigned the same reference numerals. This liquid crystal drive apparatus is provided with a temperature sensor 301 near LCD panel 20. Upon detecting an ambient temperature of liquid crystals, temperature sensor 301 sends the detection result to correction circuit 302 as temperature information.

Figure 18:
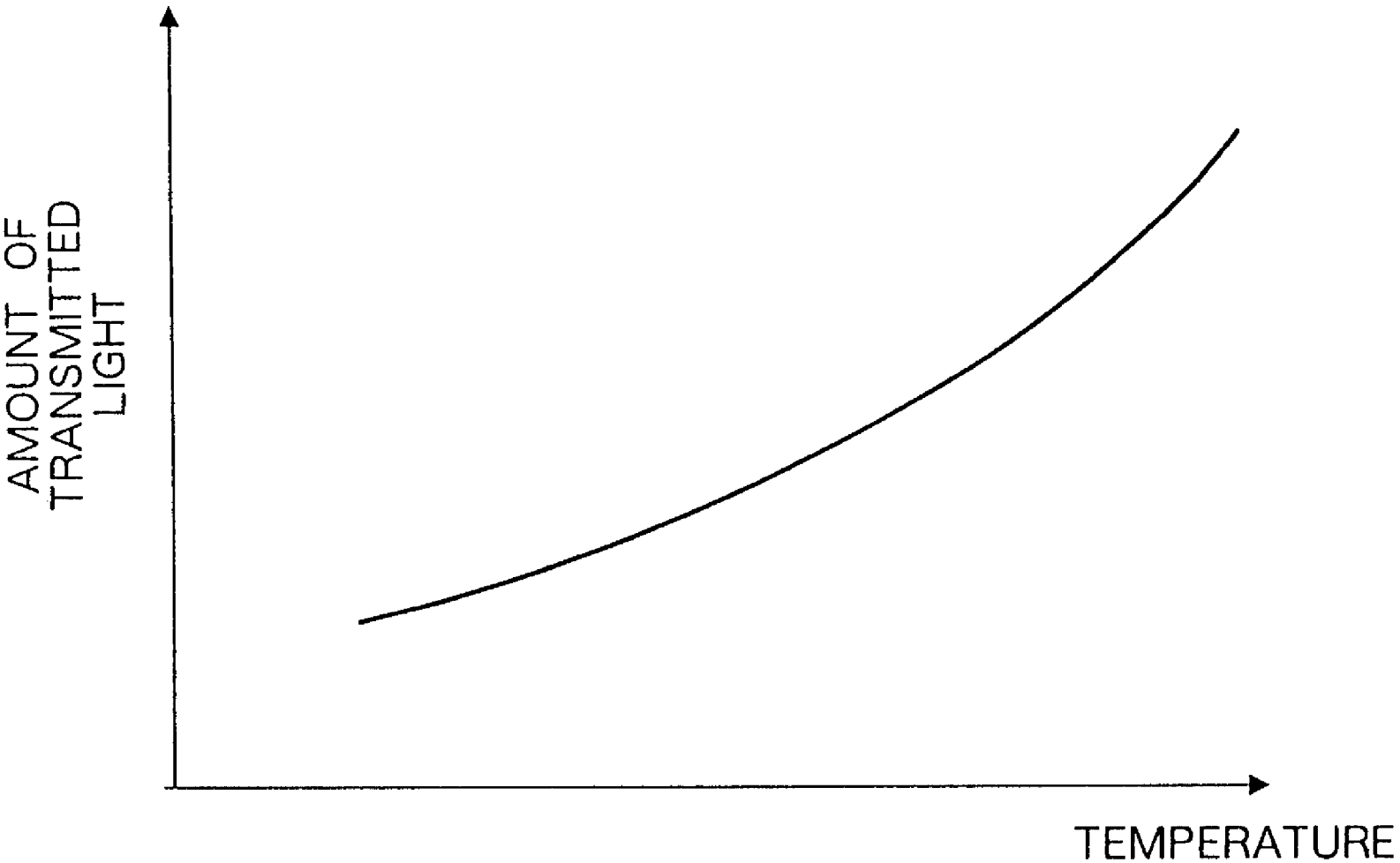
FIG. 18 illustrates a temperature characteristic of liquid crystals.

Correction circuit 302 corrects an ON-time control signal output from application time control section 102 based on the temperature information. Here, liquid crystals have a temperature characteristic as shown in FIG. 18 that the response speed of liquid crystals slows down and the amount of transmitted light decreases as a temperature decreases. In consideration of this respect, this embodiment performs corrections on an ON-time control signal in such a way that the ON time is extended as the ambient temperature of liquid crystals decreases.

Thus, such a configuration can also produce an effect of implementing a liquid crystal drive apparatus with consideration given to the temperature characteristic of liquid crystals and with further improved gradation display accuracy in addition to the effects obtained by above-described Embodiments 1 to 3.

(Embodiment 5)

Figure 19:
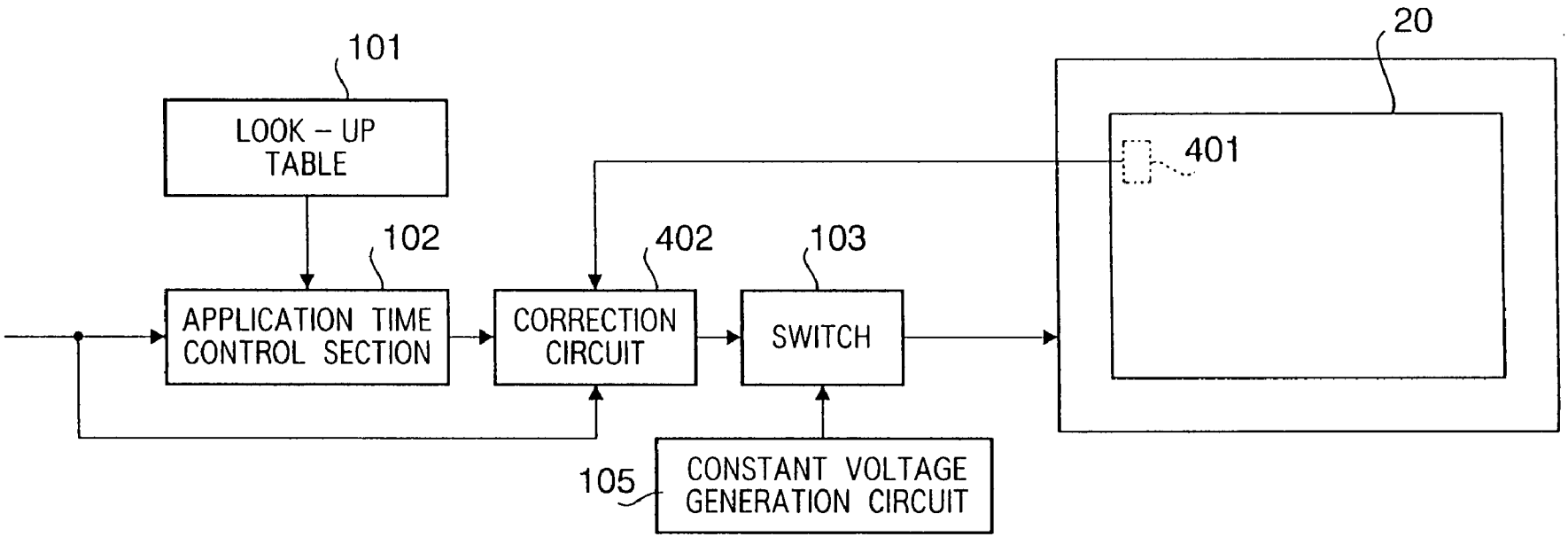
FIG. 19 is a block diagram showing an outlined configuration of a liquid crystal drive apparatus according to Embodiment 5 of the present invention.

FIG. 19 shows a configuration of a liquid crystal drive apparatus according to Embodiment 5 of the present invention, wherein the components corresponding to those in FIG. 3 are assigned the same reference numerals. This liquid crystal drive apparatus is provided with a brightness detection section 401 at an unobtrusive position peripheral to LCD panel 20. In this embodiment, brightness detection section 401 is constructed of a detection cell placed in a liquid crystal cell array and a photosensor that detects brightness of this detection cell. The brightness detection result detected by the photosensor is sent to correction circuit 402 as brightness information.

Correction circuit 402 is also fed gradation data in addition to the brightness information from brightness detection section 401 and correction circuit 402 compares the brightness information with the gradation data. Then, when the brightness information is different from the gradation data, an ON-time control signal output from application time control section 102 is corrected according to the difference. More specifically, when the brightness indicated by the brightness information is smaller than the gradation indicated by the gradation data, the ON-time control signal is corrected so that the ON-time is extended.

Here, when used for an extended period of time, brightness of an LED has a tendency to reduce due to secular variation. The brightness of a B (blue) LED out of RGB in particular may drastically drop due to secular variation. In consideration of this respect, this embodiment performs corrections on the ON-time control signal in such a way that the ON-time is extended as the brightness of transmitted light of liquid crystals decreases. In addition, this embodiment performs corrections for recovering white balance by changing a current value of each color according to the brightness information. This provides a liquid crystal drive apparatus with improved brightness balance.

Thus, this embodiment produces an effect of implementing a liquid crystal drive apparatus with further improved gradation display accuracy also taking into account a reduction of brightness due to secular variation of LEDs in addition to the effects obtained by above-described Embodiments 1 to 3.

(Other Embodiments)

This embodiment is applicable to LCD panel liquid crystal molecule operating modes such as TN (Twisted Nematic) mode, STN (Super Twisted Nematic) mode, ferroelectric crystal mode, birefringence mode, guest/host mode, dynamic scattering mode, phase transition mode, etc.

The foregoing embodiments have described the case where the applied voltage is 5 V, but the present invention is not limited to this and is also applicable to cases where the applied voltage is other than 5 V.

Above-described embodiment 3 has mainly described the case where data based on a transmitted light quantity integration system is stored in look-up table 101 of Embodiment 1, and therefore a voltage application time is set taking into account the area obtained by integrating the amount of transmitted light of liquid crystals over an LED light emission period, but the present invention is not limited to this and it is also possible to store data based on a transmitted light quantity integration system in pattern table 104 of Embodiment 2. In this case, it is possible to detect the amount of transmitted light of liquid crystals when a voltage of a certain pattern is applied to liquid crystals and set a voltage application pattern suitable to each gradation taking into account the area obtained by integrating this amount of transmitted light over an LED light emission period.

As described above in Embodiment 2, the pattern voltage application method of the present invention in particular is designed to apply a pattern voltage according to gradation data within a single LED light emission period and thereby produce a finer LCD display according to gradation data than conventional PWM control. In addition to this, by determining this application pattern according to the above-described integrated area, the present invention can produce a much finer LCD display according to gradation data.

Above-described embodiment 4 has described the case where a voltage application time is corrected according to the temperature detection result, but the present invention is not limited to this and can be modified so that the voltage application pattern is corrected according to the temperature detection result.

Likewise, above-described embodiment 5 has described the case where a voltage application time is corrected according to the brightness detection result, but the present invention is not limited to this and can be modified so that the voltage application pattern is corrected according to the brightness detection result.

Furthermore, the above-described embodiments have described the case where a pulse pattern control system taking into account a value obtained by integrating the amount of transmitted light according to the present invention is applied to control without using any D/A converter, but the present invention is not limited to this and is also applicable to control using a D/A converter. For example, a combination of a D/A converter capable of expressing specific gradations (e.g., 4 gradations) (can be a two-gradation D/A converter in the case of digital control in this embodiment) and the drive system (e.g., 4-value voltage application pattern) can express far more gradations.

Furthermore, the foregoing embodiments have described the case where the liquid crystal drive apparatus and liquid crystal drive method of the present invention are applied to a liquid crystal display apparatus based on a field sequential system, but the present invention is not limited to this and can also attain effects similar to those of the above-described embodiments even if the present invention is applied to other liquid crystal display apparatuses based on, for example, a color filter system or projector system.

Furthermore, the present invention is not limited to the foregoing embodiments, but can be implemented with various modifications.

(1) The liquid crystal drive apparatus of the present invention includes a setting section that sets a voltage application time for liquid crystals based on gradation data and a voltage supply section that supplies a predetermined applied voltage to liquid crystals for the voltage application time set by the setting section, wherein the setting section sets a voltage application time according to the gradation data taking into account the area obtained by integrating the amount of transmitted light of liquid crystals at various points in time over an LED light emission period when a constant voltage is applied to liquid crystals.

According to this configuration, a gradation display is performed by only controlling the voltage application time without changing the applied voltage value, which makes control in multi-gradation displays easier. Furthermore, gradations are expressed with an amount of transmitted light integrated of continuously changing liquid crystals, and can therefore provide a finer gradation display according to the gradation data than conventional PWM (Pulse Width Modulation), etc.

(2) The setting section in (1) of the liquid crystal drive apparatus of the present invention sets a voltage application time with reference to a table which associates gradations with voltage application times.

This configuration makes it easier to set a voltage application time according to gradations depending on the performance, etc. of liquid crystals to be driven.

(3) The table in (2) of the liquid crystal drive apparatus of the present invention is created by detecting the amount of transmitted light of liquid crystals varying with time during each period when a maximum rated voltage of liquid crystals is applied to the liquid crystals for different periods, calculating the area by integrating the detected amount of transmitted light over an LED light emission period and associating the area obtained with the gradation data to associate the gradation data with the voltage application time.

According to this configuration, the table stores a voltage application time suitable for each liquid crystal for every gradation beforehand, and therefore applying a voltage according to the voltage application time stored in this table allows a gradation display quite suitable for the input gradation data to be performed.

(4) The liquid crystal drive apparatus of the present invention includes a setting section that sets a voltage application pattern for liquid crystals based on gradation data and a voltage supply section that supplies a predetermined applied voltage to liquid crystals according to the voltage application pattern set by the setting section, wherein a gradation display is produced by controlling the amount of transmitted light within a unit LED light emission period according to the voltage application pattern.

According to this configuration, a gradation display is performed by changing the pattern of a voltage applied to liquid crystals within the unit LED light emission period, which allows a finer gradation display according to the gradation data than conventional PWM (Pulse Width Modulation), etc.

(5) The setting section in (4) of the liquid crystal drive apparatus of the present invention sets a voltage application pattern according to gradation data taking into account the area obtained by integrating the amount of transmitted light over an LED light emission period at various points in time when the voltage application pattern is applied to liquid crystals.

According to this configuration, by associating the area obtained by integrating the amount of transmitted light over an LED light emission period with each gradation and setting a pattern of a voltage applied to liquid crystals, it is possible to produce a fine gradation display as if the liquid crystals were driven at an analog voltage even if the liquid crystals are driven at a certain applied voltage. Moreover, gradations are expressed with the amount of transmitted light integrated of continuously varying liquid crystals, and the present invention can therefore provide a much finer gradation display according to the gradation data than conventional PWM (Pulse Width Modulation), etc.

(6) The setting section in (5) of the liquid crystal drive apparatus of the present invention sets a voltage application pattern with reference to a table which associates gradations with voltage application patterns.

This configuration makes it easier to set a voltage application pattern according to gradations depending on the performance, etc. of liquid crystals to be driven.

(7) The table in (6) of the liquid crystal drive apparatus of the present invention is created by detecting the amount of transmitted light of liquid crystals which varies depending on the application patterns with time when voltages of different patterns are applied to liquid crystals, calculating the area by integrating the detected amount of transmitted light over an LED light emission period and associating the area with the gradation data to associate the gradation data with the voltage application patterns.

According to this configuration, the table stores a voltage application pattern suitable for each liquid crystal for every gradation beforehand, and therefore applying a voltage according to the voltage application patterns stored in this table allows a gradation display quite suitable for the input gradation data to be performed.

(8) Furthermore, the voltage supply sections in (1) to (7) of the liquid crystal drive apparatus of the present invention do not supply an intermediate voltage between a maximum voltage and minimum voltage and only supply the maximum voltage and minimum voltage to liquid crystals to perform a gradation display.

According to this configuration, liquid crystals are only driven at a maximum voltage (e.g., 5 [v]) and minimum voltage (0 [v]) of rated voltages, and therefore the response of liquid crystals speeds up and it is possible to achieve an amount of transmitted light corresponding to the required gradation. As a result, the liquid crystals can be driven at high speed.

(9) Furthermore, the liquid crystal drive apparatus of the present invention is provided with a temperature sensor placed peripheral to liquid crystals to detect an ambient temperature of liquid crystals, wherein the setting section corrects a voltage application time or voltage application pattern according to the detection result of the temperature sensor.

According to this configuration, when the response of liquid crystals slows down as the ambient temperature of the liquid crystals decreases, the setting section corrects the voltage application time so that the voltage application time is extended accordingly or corrects the voltage application pattern. As a result, it is possible to always perform a gradation display according to the input gradation data irrespective of the state of liquid crystals.

(10) Furthermore, the liquid crystal drive apparatus of the present invention is also provided with a brightness detection section placed peripheral to liquid crystals to detect brightness of light that penetrates liquid crystals, wherein the setting section corrects a voltage application time or voltage application pattern according to the detection result of the brightness detection section.

According to this configuration, when the amount of LED light emission decreases due to secular variation and the display brightness decreases, the setting section corrects the voltage application time so that the voltage application time is extended accordingly or corrects the voltage application pattern. As a result, it is possible to always perform a gradation display with good brightness balance and according to the input gradation data irrespective of secular variation, etc. of LEDs.

(11) Furthermore, the liquid crystal drive apparatus of the present invention is a liquid crystal drive apparatus based on a field sequential system that allows LEDs of R, G and B colors to emit light sequentially and changes an aperture ratio of liquid crystals provided for the LEDs of the respective colors by a voltage applied to the liquid crystals and provided with a setting section that sets a voltage applied to liquid crystals based on gradation data and a voltage supply section that supplies the applied voltage set by the setting section to liquid crystals, wherein the applied voltage supplied by the voltage supply section is an ON/OFF pattern pulse voltage according to the gradation to be displayed and the an ON/OFF pattern is selected by associating the gradation with the amount of transmitted light from the liquid crystals integrated within the LED light emission period when each ON/OFF pattern voltage is applied to the liquid crystals.

According to this configuration, a gradation display is carried out by changing ON/OFF patterns for liquid crystals within a unit LED light emission period, and therefore it is possible to provide a finer gradation display according to gradation data than a conventional PWM (Pulse Width Modulation), etc. Furthermore, since an ON/OFF pattern to be applied to liquid crystals is selected by associating the area obtained by integrating the amount of transmitted light over the LED light emission period with each gradation, and in this way even if liquid crystals are driven by only ON/OFF, it is possible to perform a much finer gradation display as if liquid crystals were driven by an analog voltage. That is, a gradation is expressed with a value obtained by integrating an amount of transmitted light of continuously varying liquid crystals, which allows a much finer gradation display according to gradation data.

(12) Furthermore, the liquid crystal drive apparatus of the present invention is constructed in such a way that the setting section in (11) divides the light emission period of each color LED into a plurality of voltage application periods and sets as many binary data items indicating whether or not to apply an ON voltage for each divided period as divided voltage application periods.

This configuration makes it easier to set an ON/OFF pattern according to each gradation.

(13) Furthermore, the liquid crystal drive apparatus of the present invention is constructed in such a way that the voltage supply section in (11) supplies an ON/OFF pattern voltage to liquid crystals a predetermined time ahead of the time at which an LED actually starts to emit light.

This configuration applies an ON/OFF pattern voltage to liquid crystals a predetermined time ahead of the time at which an LED actually starts to emit light, and therefore it is possible to obtain desired transmittance from the time at which the LED starts to emit light. As a result, it is possible to increase brightness of the display screen without increasing the LED output.

(14) Furthermore, the gradation display method of the present invention includes a step of setting a voltage application pattern for liquid crystals within a unit LED light emission period based on gradation data and a step of supplying a predetermined voltage to liquid crystals according to the voltage application pattern set in the setting step and is characterized by producing a gradation display according to the voltage application pattern.

As described above, the present invention can provide a new liquid crystal drive apparatus and gradation display method capable of performing multi-gradation displays through digital control and driving liquid crystals at high speed.

This application is based on the Japanese Patent Application No. 2000-391136 filed on Dec. 22, 2000 and the Japanese Patent Application No. 2001-218440 filed on Jul. 18, 2001, entire content of which is expressly incorporated by reference herein.

INDUSTRIAL APPLICABILITY

The present invention relates to a liquid crystal drive apparatus and gradation display method and is applicable, for example, to a liquid crystal drive apparatus and gradation display method based on a field sequential system.

What is claimed is:

1. A liquid crystal drive apparatus, comprising:

a liquid crystal having a plurality of liquid crystal elements that control an amount of transmitted light in accordance with an applied voltage; and a voltage applicator that applies a voltage for a predetermined time to the liquid crystal elements a plurality of times during a unit light emission period, said voltage applicator having a plurality of voltage application patterns with a same total voltage application time in different ON/OFF patterns and selects one voltage application pattern to control the amount of transmitted light in the liquid crystal elements using an asymmetry of a response speed of the liquid crystal elements between a rise and a fall of a voltage application to the liquid crystal elements.

2. The liquid crystal drive apparatus of claim 1, wherein said voltage application patterns are set based on an integration value of the amount of transmitted light in the unit light emission period.

3. The liquid crystal drive apparatus of claim 1, wherein said voltage applicator sets said voltage application patterns with reference to a table that associates said voltage application patterns to gradations.

4. The liquid crystal drive apparatus of claim 1, wherein said voltage applicator does not use an intermediate voltage between a maximum voltage and a minimum voltage in said voltage application patterns and uses only said maximum voltage and minimum voltage.

5. The liquid crystal drive apparatus of claim 1, further comprising a temperature sensor positioned proximate a periphery of the liquid crystal to detect a temperature of the liquid crystal, said voltage applicator correcting said voltage application patterns according to said temperature detected by said temperature sensor.

6. The liquid crystal drive apparatus of claim 1, further comprising a brightness detector positioned proximate a periphery of the liquid crystal to detect a brightness of light penetrating the liquid crystal, said voltage applicator correcting said voltage application patterns in response to the brightness detected by said brightness detector.

7. The liquid crystal drive apparatus of claim 1, wherein said liquid crystal drive apparatus is for use in a liquid crystal display apparatus that performs a gradation display according to a field sequential system that makes light emitting diodes of red, green and blue colors emit light sequentially, and changes an aperture ratio of the liquid crystal provided in association with the light emitting diodes of the respective colors by the voltage applied to the liquid crystals.

8. A gradation display method, comprising:

selecting a voltage application pattern from a plurality of voltage application patterns that take a same total voltage application time in different ON/OFF patterns in accordance with a gradation; and applying a voltage to a plurality of liquid crystal elements in accordance with the selected voltage application pattern, wherein the selected application pattern controls an amount of transmitted light in the liquid crystal elements using an asymmetry of a response speed of the liquid crystal elements between a rise and a fall of a voltage application to the liquid crystal elements.

* * * * *